United States Patent [19]

Akselsen

[11] 4,196,602

[45] Apr. 8, 1980

[54] LOCKING LATCH HANDLE FOR WINDOWS, DOORS, AND THE LIKE

[75] Inventor: Petter O. Akselsen, Moss, Norway

[73] Assignee: Elkem-Spigerverket A/S, Oslo, Norway

[21] Appl. No.: 906,034

[22] Filed: May 15, 1978

[51] Int. Cl.[2] ..... E05B 13/10

[52] U.S. Cl. ..... 70/211; 70/196; 70/202; 70/452; 70/DIG. 57; 292/207

[58] Field of Search ..... 70/211, 212, 210, 203, 70/209, 202, 13, 171, 213, 196, 215, 201, DIG. 57, DIG. 58, 451–452; 292/173, 336.3, 150, 205, 207, 209, 106, DIG. 30, DIG. 36

[56] References Cited

U.S. PATENT DOCUMENTS

| | | | |
|---|---|---|---|
| 975,037 | 11/1910 | Hettwer | 292/106 X |
| 1,175,349 | 3/1916 | Fleming | 292/207 X |
| 1,428,785 | 9/1922 | Kuehner | 292/207 |
| 1,479,117 | 1/1924 | Trimmer | 292/209 X |
| 2,156,355 | 5/1939 | Sandberg | 70/201 X |
| 2,159,895 | 5/1939 | Hennicke | 70/196 |
| 2,169,692 | 8/1939 | Hansen | 70/212 X |
| 2,222,040 | 11/1940 | Miller | 70/213 |
| 2,223,876 | 12/1940 | Scanlan | 70/211 X |
| 2,358,554 | 9/1944 | Bixel | 70/DIG. 57 |
| 2,580,584 | 1/1952 | Nowak | 292/DIG. 36 |

FOREIGN PATENT DOCUMENTS

| | | | |
|---|---|---|---|
| 196733 | 2/1920 | Canada | 292/205 |
| 292348 | 6/1916 | Fed. Rep. of Germany | 292/205 |
| 342388 | 10/1921 | Fed. Rep. of Germany | 70/452 |
| 108560 | 9/1943 | Sweden | 70/211 |

*Primary Examiner*—Ramon S. Britts
*Assistant Examiner*—Carl F. Pietruszka
*Attorney, Agent, or Firm*—Eyre, Mann, Lucas & Just

[57] ABSTRACT

A latch handle of the type having a lever which rotates about a shaft normal to one end is locked by a key-controlled pin engaging the second end of the lever.

6 Claims, 3 Drawing Figures

LOCKING LATCH HANDLE FOR WINDOWS, DOORS, AND THE LIKE

BACKGROUND OF THE INVENTION

The present invention relates to a lockable latch handle for use in connection with windows and doors for the control of opening and closing thereof.

One type of popular latch handle employs a lever attached to and rotating about the axis of a shaft generally normal to the lever. The shaft is usually connected to a latch mechanism which controls the opening and closing of a door or window.

One type of popular locking arrangement with lever-type latch handles is a barrel-type lock concentric with the shaft which is controllable by a key. Such a latch handle arrangement has a number of disadvantages. The availability of the lever extending normal to the shaft provides a means for an unauthorized user to apply considerable force and/or torque to the shaft using the lever as a means of grasping or permitting the application of tools to break the locking mechanism. For example, it is well known to slip a pipe over the end of a latch lever to obtain great leverage and thereby to apply so much torque about the shaft that the locking mechanism concentric with the shaft is destroyed. Alternatively a pry bar may be inserted under the lever and apply great force in the outward direction on the lever to draw the shaft out of the door or window.

Any of these methods of opening the latch permits the use of the controlled door or window for entry, egress or the transferring of objects therethrough.

SUMMARY OF THE INVENTION

The present invention overcomes the disadvantages of known lever type locks by providing a structure which is highly resistant to being opened by force.

A locking lever is disclosed in which the lock engages the outboard end of a lever which is pivoted about a shaft generally normal to the inboard end thereof. The lock may optionally be included in a separately installable assembly adjacent to the end of the lever and may be installed at the same time as the lever is installed or may be later retrofitted to the latch handle as the need arises.

By the outboard locking arrangement of the present invention, the lever of the latch handle is supported at both ends against both axial and tangential force.

The location of the lock at the outboard end of the lever prevents sliding a pipe or tool over the end of the lever and applying torque in that fashion. Furthermore, support at both ends of the lever considerably strengthens the lever against deformation and axial force on the shaft due to prying. Consequently, the latch handle of the present invention is more secure than those of the prior art.

Since the lock may optionally be added to a latch handle of the present invention at any time after installation, it is feasible to install identical latch handles in locations where either locking or non-locking functions are desired and to add only the lock mechanism in the cases where locking is desired. This permits improved standardization of parts and reduced manufacturing costs due to longer production runs.

An interlocking design of the lever and lock protects the installation screws of the lock and latch handle from tampering when the lock is in the locked condition.

DETAILED DESCRIPTION OF THE PREFERRED EMBODIMENT

Figure 1:
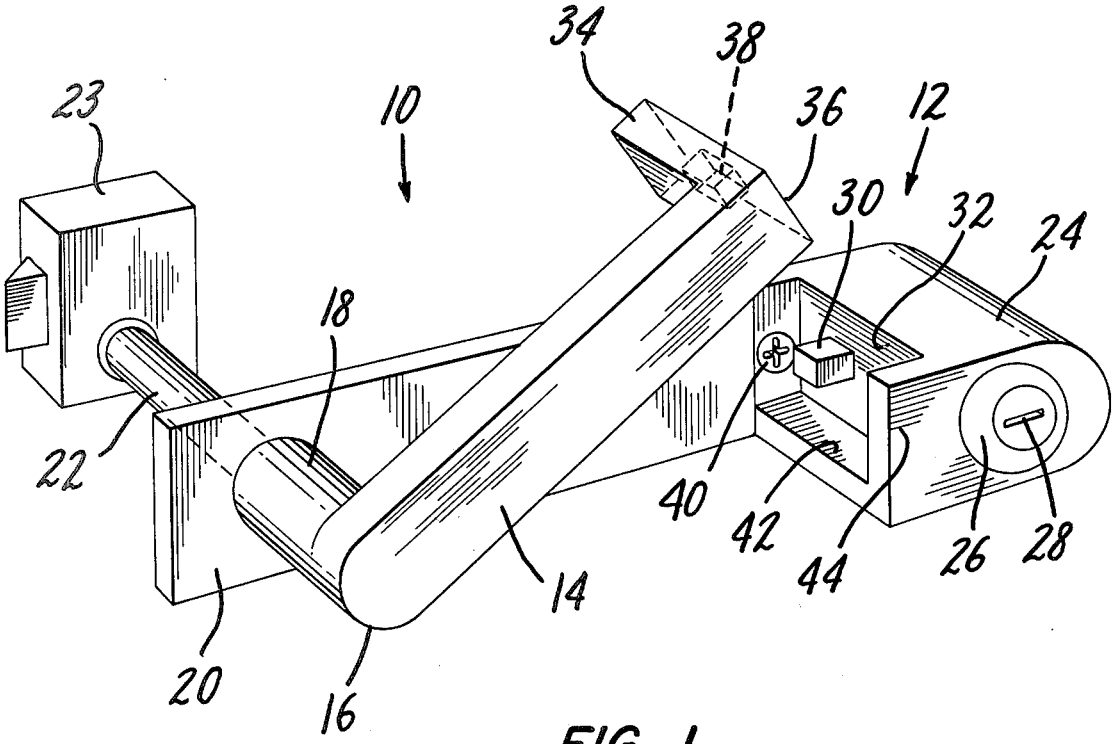
FIG. 1 shows a perspective view of the locking lever of the present invention in the unlatched position.

Referring now to FIG. 1, there is shown a lever-type latch handle 10 adjacent a locking mechanism 12. A lever 14 rotates at its first end 16 about the axis of a shaft 18 which is rotatably affixed in a plate 20. The plate 20 may be part of the locking assembly or it may alternatively be part of the structure such as a window or door which is being secured.

The shaft 18 may be attached to an inner shaft 22 which controls a standard latching mechanism 23. The inner shaft 22 is pinned or otherwise secured to rotate with the shaft 18.

The lock mechanism 12 has a body 24 containing a key-type lock 26 of any type known in the art such as the tumbler lock shown or push button, combination, magnetic, electronic or other locking means. In the preferred embodiment, a tumbler lock 26 with a key slot 28 is used. A retractable pin 30 is controlled by the key-type lock 26 to extend from or retract into a face 32 on the body 24 facing the latch handle 10.

Although the retractable pin 30 is shown to have a rectangular cross section, a round retractable pin 30 is equally within the contemplation of the invention. In addition a bevelled face on the retractable pin 30 may be employed with spring outward loading to permit locking by swinging the lever 14 into the latching position without requiring unlocking using the key-type lock 26.

A short arm 34 attached to the second end 36 of the lever 14 extends inward toward the plate 20. The short arm 34 contains blind hole or interstice 38. The hole 38 is located and sized to accommodate the retractable pin 30 when the lever 14 is rotated to its locking position as will be shown. Although the hole 38 may pass completely through the short arm 34, it is preferably blind to prevent access to the retractable pin 30.

Figure 2:
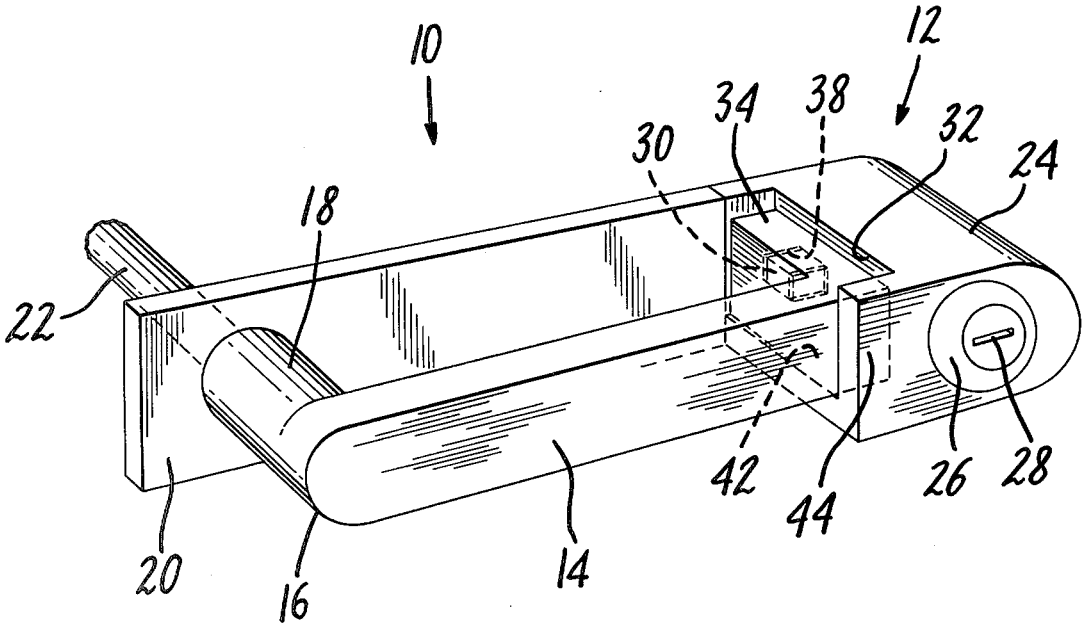
FIG. 2 shows a perspective view of an embodiment of the locking lever of the present invention in the closed and latched position.

The locking mechanism 12 is conveniently attached to the plate 20 by any convenient means known in the art such as screws 40, bolts, rivets or welding. In the preferred embodiment, a screw 40 is used to permit attachment of the locking mechanism 12 to the plate 20 at any time during initial installation or later. The location of the screw 40 is preferably in a covered position where it cannot be reached for removal when the latch handle 10 is retained in the latching position by the locking mechanism 12. This prevents an unauthorized user from overcoming the lock by merely removing the screw 40. The screw 40 is accordingly positioned such that it is covered by the short arm 34 when the lever 14 is rotated downward into the latched position shown in FIG. 2.

In order to rotate the lever 14 into the latching position shown, the retractable pin 30 is withdrawn into the body 24 to allow the short arm 34 to pass and then the retractable pin 30 is again extended thus passing into the hole 38 and holding the lever 14 in the latching position.

A ledge 42 or other stopping means is optionally provided to stop the rotation of the lever 14 to assist in aligning the retractable pin 30 with the hole 38.

An outer ledge 44 may optionally be provided behind which the lever 14 nests in its latching position. The outer ledge 44 provides additional resistance to deformation of the lever 14 such as by prying.

Although the present invention shows a latch handle 10 and a locking mechanism 12 which are especially made for use together, the locking mechanism may be used with latch handles not originally specially designed for such use. For example, a hole may be drilled in the end of the lever of a standard latch handle and the hole then may be used in the same way that hole 38 is used with the present special latch handle 10.

The longitudinally moving pin-type locking mechanism 12 may optionally be replaced by other embodiments for securing the outboard end of the lever 14 without departing from the spirit of the invention. For example, a rotating blade may be substituted for the retractable pin 30 or a pin or blade may be arranged to overlay the handle to hold it against the ledge 42 rather than entering a hole 38.

Figure 3:
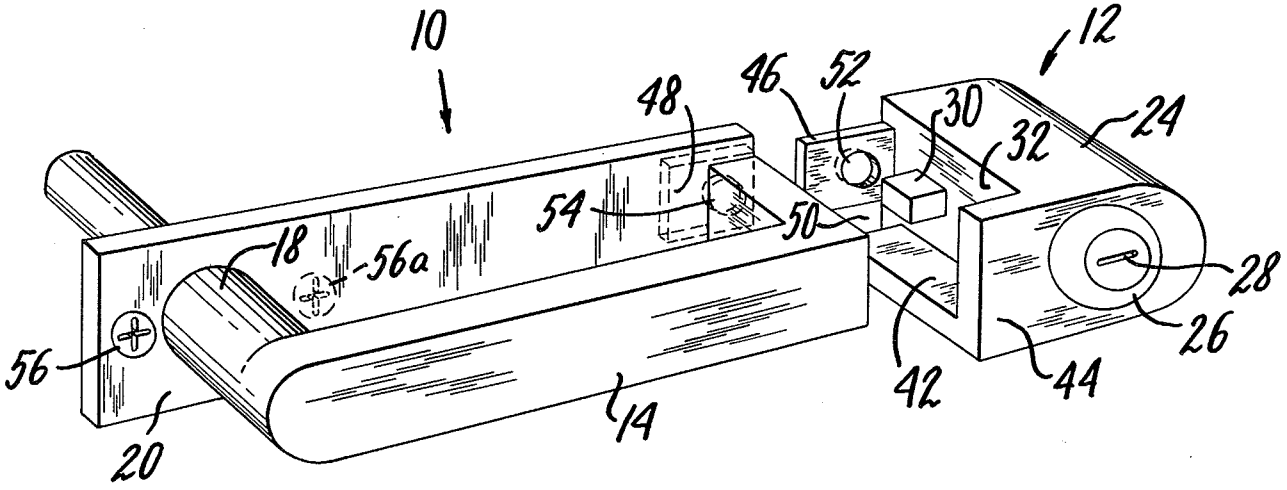
FIG. 3 shows a perspective view of an embodiment of the invention in which the lock is removeably interlocked with the plate.

Referring now to FIG. 3, there is shown a means for interlocking a plate 20 with a locking mechanism 12. A tang 46 projects outward from the rear of face 32 toward the plate 20. A recess 48 at the end of the plate 20 fits over and hides the tang 46. A slot 50 in the ledge 42 permits the plate to fit abutting face 32. In the assembled condition, tang 46 is completely hidden by plate 48. A hole 52 which is aligned with a hole 54, shown dashed, in the plate permits the attachment of the plate 20 and the locking mechanism 12 with a single screw passing completely therethrough and into the panel behind. The other end of the plate 20 may be secured by conventional means such as a screw 56. In the preferred embodiment, the screw **56*a* is substituted for the screw 56. The location of the screw 56*a* under the lever 14 in its closed position further improves the resistance of the device to tampering by making it very difficult with ordinary tools to reach the screw 56*a*** to remove it.

It will be understood that the claims are intended to cover all changes and modifications of the preferred embodiments to the invention, herein chosen for the purpose of illustration which do not constitute departures from the spirit and scope of the invention.

What is claimed is:

1. In a locking latch handle of the type wherein a latch handle rotates in a plane normal to a shaft located at a first end of said latch handle to activate a latch, said shaft being connected to said latch, the improvement comprising:

(a) means for locking said latch handle, said means for locking being adjacent to a second end of said lever;

(b) a hole in said second end;

(c) means for engaging said hole, said means for engaging said hole being controlled by said means for locking and the engagement being effective to hold said latch handle in a substantially fixed rotational and translational position;

(d) means for stopping the rotation of said latch handle in said fixed position whereby engagement of said means for engaging with said hole is enabled;

(e) means for installing said locking means;

(f) an outer ledge in said locking means;

(g) said outer ledge permitting said second end to nest behind it when said latch handle is in said fixed position; and (h) said outer ledge being adapted to resist displacement of said second end in directions both substantially parallel and substantially normal to said latch handle.

2. The latch handle recited in claim 1 further comprising said locking means being installable separately from said latch handle.

3. The latch handle recited in claim 1 wherein said locking means is separately installable as a unit adjacent said second end.

4. The latch handle recited in claim 3 further comprising:

(a) installation means for installing said locking means; and (b) covering means for covering said installation means when said lever is in said fixed position.

5. The latch handle recited in claim 4 further comprising:

(a) said installation means being at least one screw; and (b) said covering means being a short arm on said second end, said short arm extending substantially normal to said lever toward and covering said at least one screw when said lever is in its fixed position.

6. A latch control apparatus comprising:

(a) a plate;

(b) a shaft passing substantially perpendicularly through said plate;

(c) said shaft being connected to a latch;

(d) a lever disposed substantially parallel to said plate, said lever having first and second ends;

(e) said lever being attached normal to said shaft at its first end;

(f) means for permitting said lever and shaft to rotate between first and second positions;

(g) a first substantially plane surface at the second end of said lever, said first plane surface being substantially perpendicular to said plate and said lever;

(h) a locking mechanism affixed to said plate;

(i) a second substantially plane surface on said locking mechanism;

(j) said second plane surface being disposed parallel and closely adjacent to said first plane surface when said lever and shaft are rotated into their first position;

(k) a blind hole in said first plane surface;

(l) a pin extendable and retractable through said second plane surface by said locking mechanism;

(m) said pin in its extended position engaging said hole when said lever and shaft are rotated into their first position, said engaging being operative to fix said lever and shaft in their first position;

(n) said pin being retractable free of said hole whereby said lever and shaft are permitted to be rotated into their second position;

(o) removable mounting means for affixing said locking mechanism to said plate;

(p) means connected to said second end of said lever for covering said removable mounting means when said lever is in said first position;

(q) an outer ledge spaced from and parallel to said plate on said locking mechanism; and (r) said second end nesting between said outer ledge and said plate in said first position whereby outward deformation of said second end is resisted.

* * * * *